United States Patent [19]

Traugott et al.

[11] 4,010,787

[45] Mar. 8, 1977

[54] WALLET

[76] Inventors: Allan Michael Traugott, 37 Linden Ave., Atherton, Calif. 94025; Lony P. Traugott, 91 Flood Circle, Atherton, Calif. 94025

[22] Filed: Nov. 3, 1975

[21] Appl. No.: 628,163

[52] U.S. Cl. ..... 150/35; 150/38; 150/39

[51] Int. Cl.[2] ..... A45C 1/06

[58] Field of Search ..... 150/35, 36, 38, 39

[56] References Cited

UNITED STATES PATENTS

| | | | |
|---|---|---|---|
| 1,326,602 | 12/1919 | McKey | 150/36 |
| 1,580,346 | 4/1926 | Sutter | 150/38 |
| 1,683,996 | 9/1928 | Snow | 150/35 UX |
| 3,777,795 | 12/1973 | Graetz | 150/35 |

*Primary Examiner*—Donald F. Norton
*Attorney, Agent, or Firm*—Townsend and Townsend

[57] ABSTRACT

A wallet for carrying currency of various denominations together with a plurality of credit cards is disclosed. The wallet includes a pair of at least partially resilient foldable rectangular planar members having length and width dimensions greater than the dimensions of the currency. Each planar member has inner and outer faces, and the members are adapted to normally be maintained with the inner faces thereof in near abutment one to the other. When so disposed, the members are foldable along a central fold line so that the outer face of one of the planar members is concealed. A plurality of slit pockets are arranged in the outer face of the planar member concealed in the folded configuration. The openings of the slit pockets are disposed on each side of the fold line and directed toward the fold line. Straps join the lengthwise lateral edges of the respective planar members which are disposed oppositely when the inner faces thereof are in near abutment. Currency of high and low denominations respectively can be disposed against the respective inner faces of the members and retained thereagainst by the straps. In addition, a plurality of credit cards can be located in the slit pockets so that they are concealed when the wallet is folded.

6 Claims, 5 Drawing Figures

WALLET

BACKGROUND OF THE INVENTION

The present invention relates to wallets and in particular to a wallet for carrying currency of various denominations together with a plurality of credit cards.

Bill holders of the type illustrated in the McKey patent, U.S. Pat. No. 1,326,602, are well known. In this type of bill holder, two planar members are joined by straps so that the planar members can fold outwardly in either direction. Currency can be maintained against the inner faces of either of the planar members for storage on the person.

Bill holders of the McKey type have rather limited utility, however, since they are only adapted for the storage of currency. A conventional wallet, on the other hand, is adapted to carry a wide variety of items, the most significant of which is a plurality of credit cards. It has been known to add pockets to devices of the McKey type, as illustrated in the patent to Sutter, U.S. Pat. No. 1,580,346. However, when the credit cards are located in such pockets, only one side of the holder can be used for currency, and the thickness of the holder will be greatly increased, resulting in a cumbersome and unattractive wallet.

SUMMARY OF THE INVENTION

The present invention provides a wallet for carrying currency of various denominations together with a plurality of credit cards. The wallet includes a pair of at least partially resilient foldable rectangular planar members having length and width dimensions greater than the dimensions of the currency. Each planar member has inner and outer faces, and the members are adapted to normally be maintained with the inner faces thereof in near abutment one to the other. When so disposed, the members are foldable along a central fold line so that the outer face of one of the planar members is concealed. A plurality of slit pockets are arranged in the outer face of the planar member concealed in the folded configuration. The openings of the slit pockets are disposed on each side of the fold line and directed toward the fold line. Straps join the lengthwise lateral edges of the respective planar members which are disposed oppositely when the inner faces thereof are in near abutment. Currency of high and low denominations respectively can be disposed against the respective inner faces of the members and retained thereagainst by the straps. In addition, a plurality of credit cards can be located in the slit pockets so that they are concealed when the wallet is folded.

The present invention provides a wallet for carrying not only currency but also a plurality of credit cards in a convenient, attractive and relatively flat configuration. The credit cards are carried on the outside face of one of the members in partially overlapping relationship so that the wallet can be conveniently folded into a relatively flat configuration for storage on the person. Both of the interior faces of the planar members can still be used for currency storage so that currency of relatively large denominations can be stored in one side and of relatively small denominations on the other side and the denominations do not become confused. In the preferred embodiment of the present invention, the straps are radiused so that new money will not be damaged when withdrawn from the wallet.

The novel features which are believed to be characteristic of the invention, both as to organization and method of operation, together with further objects and advantages thereof will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
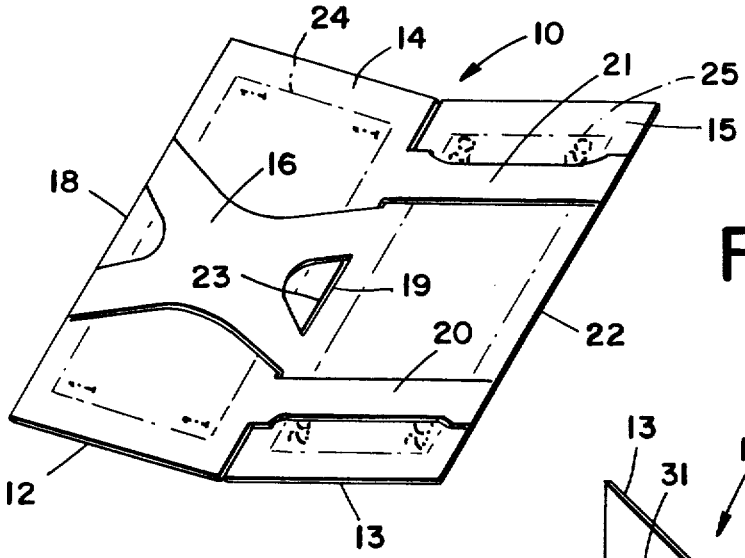
FIG. 1 is a perspective view of the wallet of the present invention opened so that the inner faces of the planar members are exposed.

The wallet 10 of the present invention is illustrated in the open configuration in FIG. 1. Wallet 10 includes a pair of rectangular planar members 12, 13. For reasons which will become apparent hereinafter, each planar member 12, 13 is constructed of at least partially resilient foldable material. In FIG. 1, the respective inner faces 14, 15 of planar members 12, 13 are exposed.

A centrally located, generally x-shaped strap 16 is depicted in FIG. 1 as overlying the inner face 14 of member 12. Two of the legs of x-shaped strap 16 are connected to a lateral edge 18 of planar member 12. The other two legs of x-shaped strap 16 are connected to a lateral edge 19 of planar member 13. It is apparent that when planar members 12, 13 are placed so that their inner faces 14, 15 are in near abutment, lateral edge 18 will be disposed oppositely from lateral edge 19.

A pair of elongate straps 20, 21 overlie the inner face 15 of planar member 13 in the configuration illustrated in FIG. 1. Straps 20, 21 are located on opposite sides of x-shaped strap 16, and each extends from a lateral edge 22 of planar member 13 to a lateral edge 23 of planar member 12. As with lateral edges 18, 19 to which x-shaped strap 16 are joined, lateral edges 22 and 23 will be oppositely disposed when planar members 12, 13 are located so that their inner faces 14, 15 are in near abutment.

Because of the way in which x-shaped strap 16 and elongate straps 20, 21 are attached to oppositely disposed lateral edges of the planar members 12, 13, the planar members can be folded outwardly with respect to one another in either widthwise direction. However, no matter how the planar members are folded apart, x-shaped strap 16 will overlie one of the inner faces 14, 15, and straps 20, 21 will overlie the other inner face. Accordingly, currency such as 24, 25 can be disposed on inner faces 14, 15 of the respective planar members 12, 13 and will be retained thereagainst by straps 16, 20 and 21 for storage of the currency. Since two locations are provided for the storage of such currency, it is suggested that currency of small denominations be retained against one of the inner faces and currency of relatively large denominations be retained against the other inner face to minimize confusion between currency of different denominations.

In the perspective view of FIG. 2, wallet 10 is again unfolded along fold lines 17, 17' and located so that the respective outer faces 30, 31 of planar members 12, 13 are exposed. In the preferred embodiment of the present invention, no pockets or other accessories are located on the outer face 31 of planar member 13. However, a plurality of slit pockets 32–37 are located on the outer face 30 of planar member 12, as described in more detail hereinbelow.

The openings of slit pockets 32–37 are all parallel to the widthwise (i.e. the smaller) dimension of rectangular planar member 12. Certain of the slit pockets 32-34 are located on one side of the fold line 17' of planar member 12, and other slit pockets 35–37 are located on the other side of the lengthwise center. However, each of the slit pockets is directed toward the fold line 17 of rectangular planar member 12. Other pockets such as 38, 39 can be located on outer face 30 of planar member 12 to accommodate keys, stamps and other items.

Figure 3:
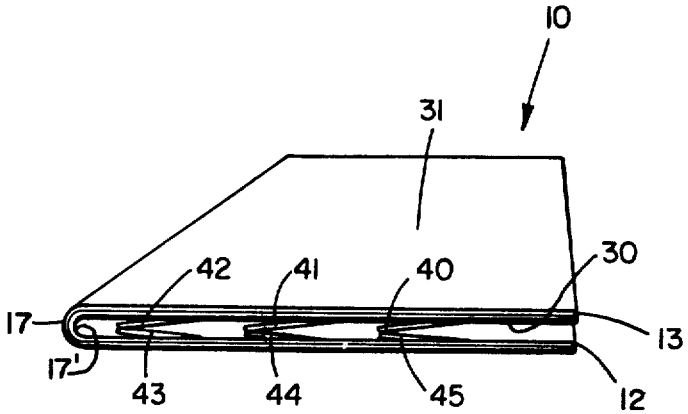
FIG. 3 is a perspective view of the wallet of the present invention in the folded configuration.

A plurality of credit cards such as 40-45 can be located in the respective slit pockets 32-37. When planar members 12, 13 of wallet 10 are disposed so that their interior faces are in near abutment, planar members 12, 13 can be folded along fold lines 17, 17' as illustrated in FIG. 3. Planar members 12, 13 are folded so that the inner face 30 of planar member 12 is concealed, and outer face 31 of planar member 13 is exposed. In this manner, credit cards 40–45 together with the currency is contained within the interior folds of wallet 10 for convenient and safe carrying thereof.

Figure 2:
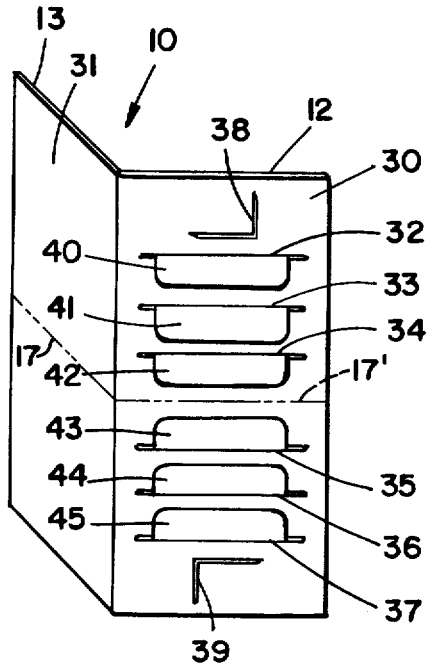
FIG. 2 is a perspective view of the outer surfaces of the planar members of the wallet of the present invention in the open configuration.

It is readily apparent in FIG. 2 that the arrangement of slit pockets 32–37 causes credit cards 40-45 to be disposed in a partially overlapping relationship. When wallet 10 is folded as illustrated in FIG. 3, the partially overlapping relationship of the credit cards is maintained. In this manner, the thickness of the folded wallet is substantially less than the thickness of a wallet in which the credit cards are carried in stacked relationship.

Figure 4:
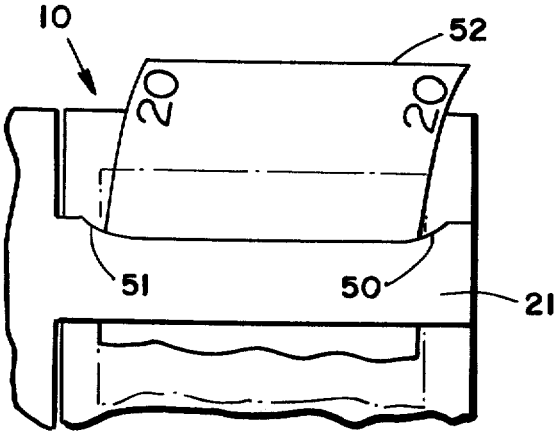
FIG. 4 is a fragmentary view of one of the elongate straps of the present invention.

One of the elongate straps 21 of wallet 10 is illustrated in detail by way of reference to FIG. 4. As illustrated therein, the corners 50, 51 of the outermost edge of strap 21 are radiused. As the result, when currency, such as 52, is withdrawn from wallet 10, the likelihood that the currency will be torn is minimized. Tearing of the currency in this manner is a particular problem with new currency which is relatively stiff, but this problem is substantially reduced by implementation of radiused corners 50, 51.

Figure 5:
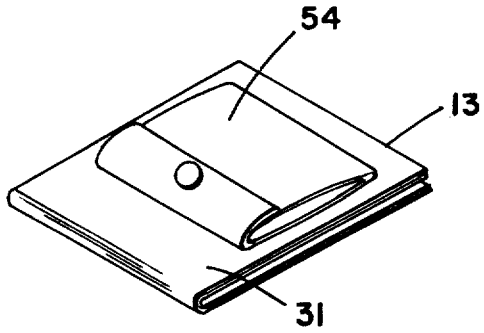
FIG. 5 is a perspective view of an alternate embodiment of the wallet of the present invention in the folded configuration.

An alternate embodiment of the present invention which includes a coin purse attachment 54 is illustrated in FIG. 5. Using reference numbers identical to those used to describe the previous embodiment for similar parts, coin purse 54 is located on the outer face 31 of planar member 13 so that it is exposed even when the wallet is in its fully folded configuration. It is anticipated that this alternate embodiment of the present invention is particularly applicable to ladies' wallets in which change is normally carried in the wallet itself.

While preferred embodiments of the present invention have been illustrated in detail, it is apparent that modifications and adaptations of those embodiments will occur to those skilled in the art. However, it is to be expressly understood that such modifications and adaptations are within the spirit and scope of the present invention, as set forth in the following claims.

What is claimed is:

1. A wallet for carrying currency of various denominations together with a plurality of credit cards, said wallet comprising:

a pair of at least partially resilient foldable rectangular planar members having relatively larger length and smaller width dimensions greater than the dimensions of said currency, each said planar member having inner and outer faces respectively with the inner faces of said members adapted to normally be maintained in near abutment, the members in combination being foldable lengthwise along central fold lines so that the outer face of one of the planar members is concealed in said folded configuration;

a plurality of slit pockets arranged in the outer face of said one of the planar members, the openings of said slit pockets being disposed generally parallel to the widthwise dimension of said one rectangular member, said slit pockets being disposed on each side of the fold line with the openings of said slit pockets disposed toward said fold line; and strap means joining lengthwise lateral edges of the respective planar members disposed oppositely when the inner faces of the planar members are in near abutment so that the currency of high and low denominations respectively can be disposed against the respective inner faces of the members and retained thereagainst by the strap means and a plurality of credit cards can be located in the slit pockets and are concealed when the planar members are maintained in their folded configuration.

2. A wallet as recited in claim 1 wherein the strap means includes a generally x-shaped strap joining one lengthwise edge of one said planar member with the oppositely disposed edge of the other planar member, said x-shaped strap being centrally disposed in the lengthwise direction, and a pair of elongate straps disposed on opposite sides of x-shaped strap and joining the other lengthwise lateral edge of said one planar member to the oppositely disposed edge of the other planar member.

3. A wallet as recited in claim 2 wherein the outwardly disposed edges of the elongate straps are radiused to minimize tearing of the currency.

4. A wallet as recited in claim 1 and additionally comprising a coin purse disposed on the outer face of the other planar member so that said coin purse is exposed when the planar members are maintained in their folded configuration.

5. A wallet as recited in claim 1 and additionally comprising key and stamp pockets disposed on the outer face of said one planar member so that the key and stamp pockets are concealed when the planar members are maintained in the folded configuration.

6. A wallet for carrying currency of various denominations together with a plurality of credit cards, said wallet comprising:

a pair of at least partially resilient foldable rectangular members having relatively larger length and smaller width dimensions greater than the dimensions of said currency, said planar members having inner and outer faces respectively with the inner faces of said members adapted to normally be maintained in near abutment, the members in combination being foldable lengthwise along central fold lines so that the outer face of one of the planar members is concealed in said folded configuration;

a plurality of slit pockets arranged in the outer face of said one of the planar members, the openings of said slit pocket being disposed generally parallel to the widthwise dimension of said one rectangular member, such slit pockets being disposed on each side of the fold line of said one rectangular member with the openings of said slit pockets disposed towards said fold line;

a generally x-shaped strap joining one lengthwise edge of said planar member with the oppositely disposed edge of the other planar member when the inner faces of the planar members are in near abutment; and a pair of elongate straps disposed on opposite sides of the x-shaped strap and joining the other lengthwise lateral edge of said one planar member to the edge of the other planar member oppositely disposed when the inner faces of the planar members are in near abutment, the outwardly disposed edges of the elongate straps being radiused to minimize tearing of the currency, so that the currency of high and low denominations respectively can be disposed against the respective inner faces of the members and retained thereagainst by the x-shaped strap and the elongate straps and a plurality of credit cards can be located in the slit pockets and are concealed when the planar members are maintained in their folded configuration.

* * * * *